US008066392B2

(12) United States Patent
Wang

(10) Patent No.: US 8,066,392 B2
(45) Date of Patent: Nov. 29, 2011

(54) MULTI-FUNCTION REPLACEABLE MODULAR LED LAMP

(75) Inventor: Robert Wang, Luch (TW)

(73) Assignee: Ceramate Technical Co., Ltd., Taoyuan County (TW)

( * ) Notice: Subject to any disclaimer, the term of this patent is extended or adjusted under 35 U.S.C. 154(b) by 345 days.

(21) Appl. No.: 12/476,338

(22) Filed: Jun. 2, 2009

(65) Prior Publication Data

US 2010/0302758 A1 Dec. 2, 2010

(51) Int. Cl.
*F21V 19/04* (2006.01)
*F21V 21/00* (2006.01)
*F21V 23/04* (2006.01)

(52) U.S. Cl. ..... 362/20; 362/249.02; 362/276

(58) Field of Classification Search ..... 362/20, 362/184, 185, 186, 200, 208, 646, 235, 236, 362/237, 240, 249.02, 276, 311.02
See application file for complete search history.

(56) References Cited

U.S. PATENT DOCUMENTS

| | | | | |
|---|---|---|---|---|
| 7,109,880 | B2 * | 9/2006 | Sibalich et al. | 340/693.6 |
| 7,327,254 | B2 * | 2/2008 | Chen | 340/545.2 |
| 2005/0099317 | A1 * | 5/2005 | Pederson | 340/815.45 |
| 2010/0290207 | A1 * | 11/2010 | Chan et al. | 362/20 |

* cited by examiner

*Primary Examiner* — David Crowe
(74) *Attorney, Agent, or Firm* — Ming Chow; Sinorica, LLC

(57) ABSTRACT

A multi-function replaceable modular LED lamp includes a lamp base, a lampshade, a plurality of LED modules, a power supply control circuit board, and a detector. The lampshade is disposed on the lamp base. The plurality of LED modules is detachably disposed in the lamp base and electrically connected to the power supply control circuit board. The detector is detachably disposed on the lamp base and electrically connected to the power supply control circuit board. The detector has a specific function, such as, an earthquake detection, a human body detection, a disaster detection, an alarm detection and the like. The LED modules, the detector and the other parts of the present invention are replaceable with ease, which has the advantages of environmental protection and energy saving.

9 Claims, 3 Drawing Sheets

MULTI-FUNCTION REPLACEABLE MODULAR LED LAMP

BACKGROUND OF THE INVENTION

1. Field of the Invention

The present invention relates to a multi-function replaceable modular LED lamp.

2. Description of the Prior Art

A conventional LED lamp comprises a plurality of light emitting diodes secured to a lamp base. In case one of the light emitting diodes malfunctions, the illumination is not even. This also influences the sense of sight for beauty. In order to overcome the aforesaid problem, it is necessary to replace a whole lamp, which costs a consumer a lot of money, increases the amount of trash, and is not friendly to environmental protection.

Accordingly, the inventor of the present invention has devoted himself based on his many years of practical experiences to the development of a multi-function replaceable modular LED lamp.

SUMMARY OF THE INVENTION

According to the present invention, there is provided a multi-function replaceable modular LED (light emitting diode) lamp, comprising:

a lamp base, the lamp base being made of aluminum and comprising a bottom, a circular wall surrounding the bottom, and a fixture secured to a central portion of the bottom;

a lampshade, the lampshade being disposed on the light base and formed with a central through hole;

a plurality of LED modules, the plurality of LED modules being detachably disposed on the bottom of the lamp base, each of the LED modules comprising a base plate and a heat sink rubber pad, the base plate comprising a plurality of light emitting diodes thereon and a connector at one side thereof, the heat sink rubber pad being disposed under the base plate, the heat sink rubber pad being attached to the bottom of the lamp base;

a power supply control circuit board, the power supply control circuit board being detachably disposed on the bottom of the lamp base and comprising a plurality of sockets corresponding in number to the LED modules for connecting with the connector of each of LED modules; and a detector, the detector being detachably disposed on the fixture of the lamp base and having an upper end inserted through the central through hole of the lampshade and exposed out the lampshade.

DETAILED DESCRIPTION OF THE PREFERRED EMBODIMENT

Embodiments of the present invention will now be described, by way of example only, with reference to the accompanying drawings.

Figure 1:
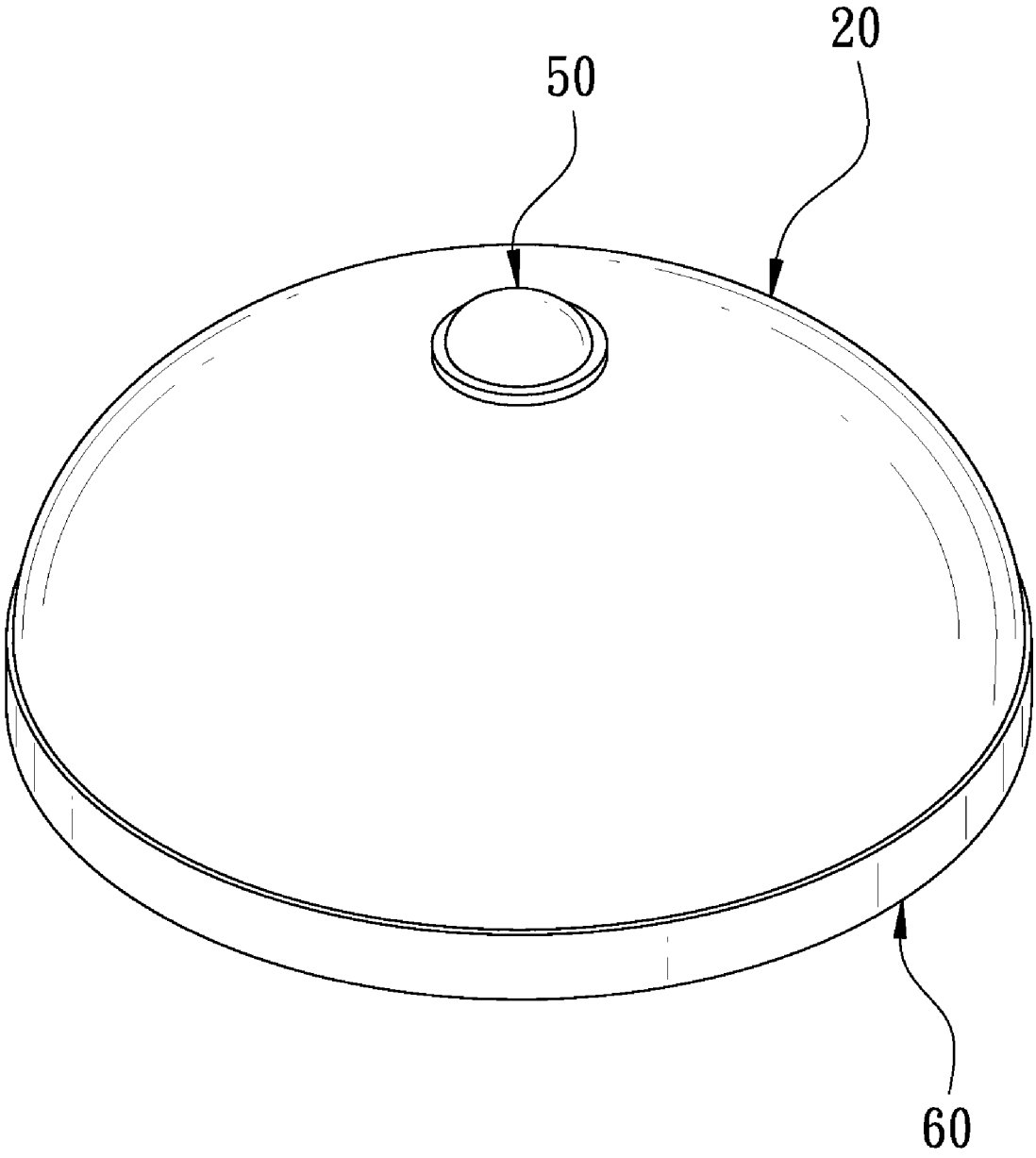
FIG. 1 is a perspective view of the present invention.
Figure 2:
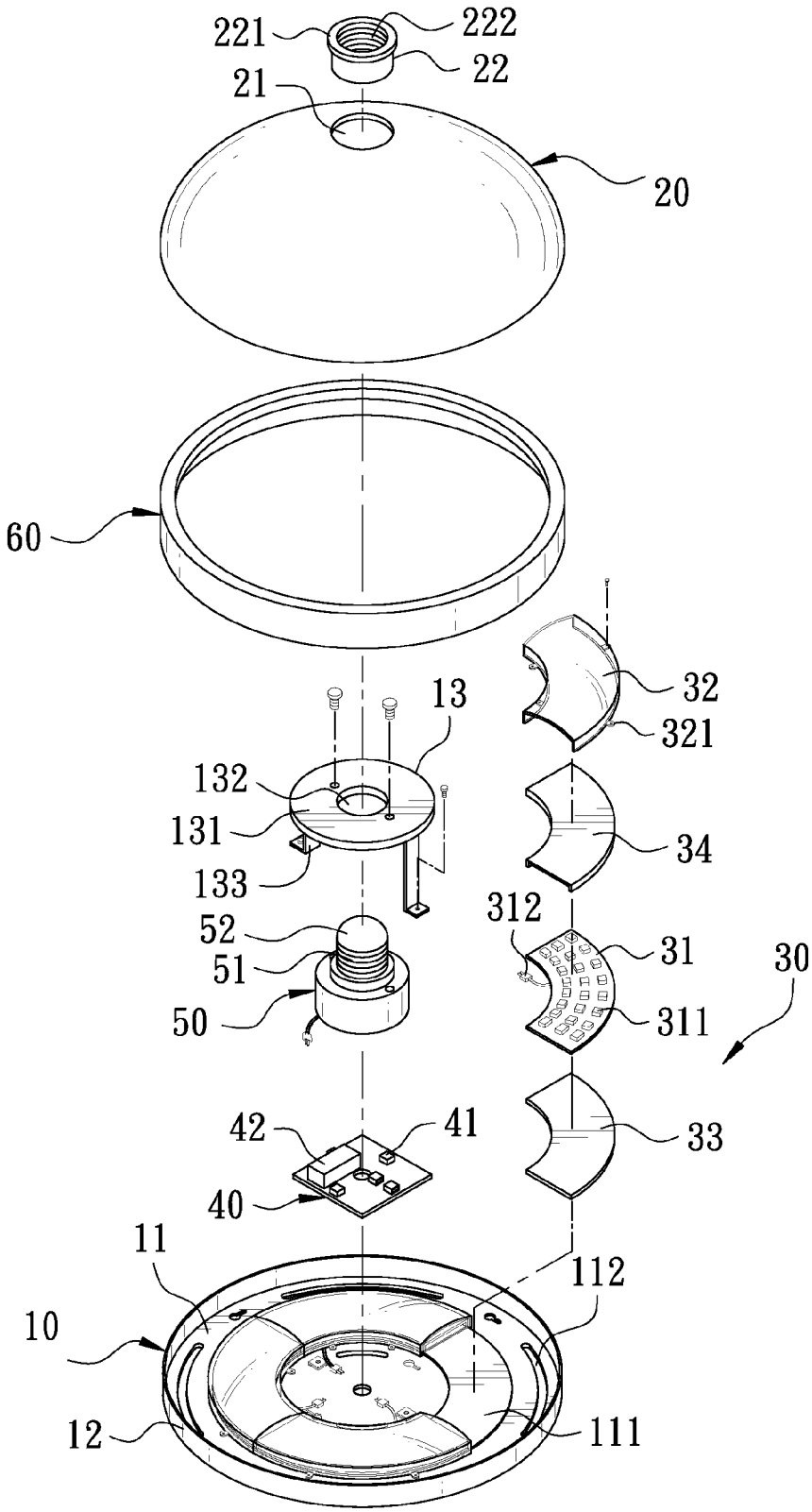
FIG. 2 is an exploded view of the present invention.
Figure 3:
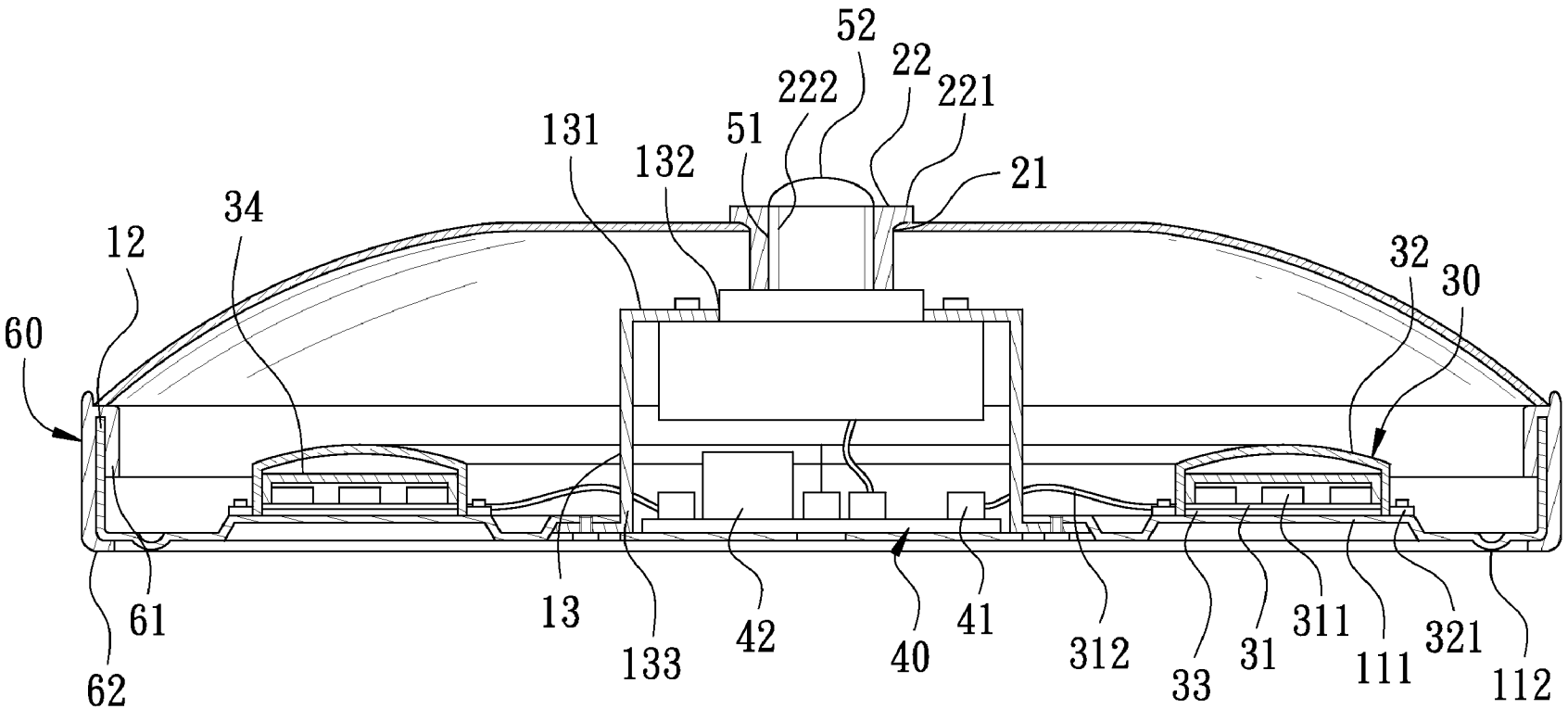
FIG. 3 is a cross-sectional view of the present invention.

As shown in FIGS. 1 through 3, a multi-function replaceable modular LED lamp according to a preferred embodiment of the present invention comprises a lamp base 10, a lampshade 20, a plurality of LED (light emitting diode) modules 30, a power supply control circuit board 40, a detector 50, and a decorating ring 60.

The lamp base 10 is made of aluminum which is easy to radiate heat. The lamp base 10 is in a disc shape, and comprises a bottom 11, a circular wall 12 surrounding the bottom 11, and a fixture 13 secured to the bottom 11. The fixture 13 comprises a circular seat 131 having a through hole 132 and a pair of feet 133 to be secured to the bottom 11. The bottom 11 is integrally formed with a circular protrusion 111 at a central portion of the bottom 11 and a plurality of convex ribs 112 extending downward.

The lampshade 20 is made of a material which is pervious to light. The lampshade 20 has a cambered surface and is disposed on the light base 10. The lampshade 20 is formed with a central through hole 21. The lampshade 20 comprises a lock cap 22 in a cylinder shape. The lock cap 22 is inserted into the central through hole 21 of the lampshade 20. The lock cap 22 has an outer flange 221 at an upper end thereof and a threaded inner wall 222. The outer flange 221 is located on the lampshade 20 after the lock cap 22 is inserted into the central through hole 21.

The plurality of LED modules 30 is disposed on the circular protrusion 111 of the bottom 11 of the lamp base 10. Each LED module 30 comprises a base plate 31, a lid 32 and a heat sink rubber pad 33. The base plate 31 corresponds to the circular protrusion 111 of the bottom 11 and is in a fan-like shape so that the base plate 31 is disposed on the protrusion 111 to together form a ring with the other LED modules 30. The base plate 31 of each LED module 30 comprises a plurality of light emitting diodes 311 thereon and a connector 312 at one side thereof. The lid 32 is disposed on the base plate 31 and corresponds in shape to the base plate 31. The lid 32 comprises protruding lugs 321 at two sides thereof such that the LED module 30 is coupled to the bottom 11 by means of the protruding lugs 321 of the lid 32, which provides an easy way for maintenance. The lid 32 is made of a material which is pervious to light and has a specific color for providing a blending lighting effect. The heat sink rubber pad 33 is disposed under the base plate 31 of the LED module 30 so that the light emitting diodes 311 are able to radiate heat to the bottom 11 made of aluminum through the heat sink rubber pad 33 for providing a heat sink effect. In addition, each LED module 30 further comprises a color covering 34 between the base plate 31 and the lid 32. The color covering 34 corresponds to the light emitting diodes 311 for making a color adjustment of light.

The power supply control circuit board 40 is secured to the central portion of the bottom 11 of the lamp base 10, and comprises a plurality of sockets 41 corresponding in number to the LED modules 30 for connecting with the connector 312 of each LED module 30. The power supply control circuit board 40 further comprises a battery 42 at one side thereof.

The detector 50 is a cylinder having an upper section inserted through the through hole 132 of the fixture 13 and secured on the circular seat 131. The upper section of the detector 50 is formed with outer threads 51. The detector 50 is further inserted through the central through hole 21 of the lampshade 20 and engaged with the lock cap 22. The detector 50 has an upper end exposed out the lampshade 20 for detecting the external circumstance. The detector 50 is electrically connected to the power supply control circuit board 40. The detector 50 may be an emergency lighting detector, a human body detector, an alarm detector, a sound detector, a fire detector, an earthquake detector, a power failure detector, a carbon monoxide detector or the like. In this embodiment, the detector 50 is a power failure detector, and has a power source 52 at the upper end for detecting power failure. When there is a power failure, the battery 42 will provide power supply for emergency lighting.

The decorating ring 60 is disposed around the circular wall 12. The decorating ring 60 has an upper flange 61 and a lower flange 62 at upper and lower ends thereof, respectively. The decorating ring 60 is secured to the lamp base 10 with the upper flange 61 and the lower flange 62, which is replaced with ease.

Referring to the FIG. 2, the preferred embodiment of the present invention is in the form of a ceiling lamp. The bottom 11 of the lamp base 10 is secured to the ceiling of a house. There is an interval between the lamp base 10 and the ceiling by means of the convex ribs 112 for providing a heat sink effect.

When one or some of the light emitting diodes 32 malfunction, the user only dismantles the malfunctioning LED module 30 and replaces with a new one. When replacement, the connector 312 of the malfunctioning LED module 30 is pulled out from the socket 41 of the power supply control circuit board 40 and screws on the lid 32 of the LED module 30 are loosened, so the malfunctioning LED module 30 is replaced with ease. This is very convenient for maintenance. The other parts of the present invention, such as the lampshade 20, the power supply control circuit board 40, the detector 50, and the decorating ring 60, are also replaced with ease.

The detector 50 may be provided as desired, which has a specific function, for example, an earthquake detection, a fire detection, a power failure detection and the like. When in use, the detector 50 is in conjunction with a conventional LED lightning for enhancing its efficiency. In addition, the detector 5 may be incorporated with the applicant's other inventions, using a wall-mount switch for the power supply of the detector 50. In case the power supply is interrupted, the detector 50 still gets the power supply from the battery 42 of the power supply control circuit board 40.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A multi-function replaceable modular LED (light emitting diode) lamp, comprising:

a lamp base, the lamp base being made of aluminum and comprising a bottom, a circular wall surrounding the bottom, and a fixture secured to a central portion of the bottom;

a lampshade, the lampshade being disposed on the light base and formed with a central through hole;

a plurality of LED modules, the plurality of LED modules being detachably disposed on the bottom of the lamp base, each of the LED modules comprising a base plate and a heat sink rubber pad, the base plate comprising a plurality of light emitting diodes thereon and a connector at one side thereof, the heat sink rubber pad being disposed under the base plate, the heat sink rubber pad being attached to the bottom of the lamp base;

a power supply control circuit board, the power supply control circuit board being detachably disposed on the bottom of the lamp base and comprising a plurality of sockets corresponding in number to the LED modules for connecting with the connector of each of LED modules; and a detector, the detector being detachably disposed on the fixture of the lamp base and having an upper end inserted through the central through hole of the lampshade and exposed out the lampshade.

2. The multi-function replaceable modular LED lamp as claimed in claim 1, wherein the lamp base has a circular shape and the base plate of each of the LED modules has a fan-like shape, the plurality of LED modules being arranged on the bottom of the lamp base in an annular shape, the power supply control circuit board being disposed on the central portion of the bottom.

3. The multi-function replaceable modular LED lamp as claimed in claim 1, wherein the bottom of the lamp base is integrally formed with a circular protrusion corresponding to the plurality of LED modules.

4. The multi-function replaceable modular LED lamp as claimed in claim 1, wherein the bottom of the lamp base is integrally formed a plurality of convex ribs extending downward.

5. The multi-function replaceable modular LED lamp as claimed in claim 1, wherein the detector is a power failure detector and has a power source, the power supply control circuit board comprising a battery thereon to provide power supply to the detector for providing emergency lighting.

6. The multi-function replaceable modular LED lamp as claimed in claim 1, wherein the fixture comprises a circular seat, the circular seat having a through hole at a central portion thereof for the detector to be inserted through the through hole of the fixture and secured to the circular seat of the fixture, the fixture further comprising a pair of feet to be secured to the bottom.

7. The multi-function replaceable modular LED lamp as claimed in claim 1, wherein the lampshade comprises a lock cap, the lock cap being inserted onto the central through hole of the lampshade, the lock cap having an outer flange at an upper end thereof and a threaded inner wall, the detector being formed with outer threads to engage with the lock cap.

8. The multi-function replaceable modular LED lamp as claimed in claim 1 further comprising a decorating ring, the decorating ring being disposed around the circular wall of the lamp base, the decorating ring having an upper flange and a lower flange at upper and lower ends thereof for securing the decorating ring to the lamp base.

9. The multi-function replaceable modular LED lamp as claimed in claim 1, wherein each of the LED modules further comprises a color covering at one side opposite to the heat sink rubber.

* * * * *